United States Patent [19]

Kershaw

[11] Patent Number: 4,865,557

[45] Date of Patent: Sep. 12, 1989

[54] SECURITY DEVICE FOR ELECTRIC APPLIANCES

[76] Inventor: Alex Kershaw, 36 Valencia Rd., Orinda, Calif. 94563

[21] Appl. No.: 121,510

[22] Filed: Nov. 13, 1987

[51] Int. Cl.[4] ..... H01R 13/44

[52] U.S. Cl. ..... 439/133; 439/134; 439/367

[58] Field of Search ..... 174/138 F; 439/133, 439/134, , 149, 301, 304, 367

[56] References Cited

U.S. PATENT DOCUMENTS

| | | | |
|---|---|---|---|
| 4,219,693 | 8/1980 | French | 174/138 F X |
| 4,488,764 | 12/1984 | Pfenning et al. | 439/133 |
| 4,592,607 | 6/1986 | Pejovic | 439/133 |
| 4,647,726 | 3/1987 | Blum | 439/304 X |
| 4,673,230 | 6/1987 | Baumgart | 439/133 |
| 4,749,363 | 6/1988 | Luska et al. | 439/367 |

*Primary Examiner*—Steven Mottola

*Attorney, Agent, or Firm*—Paul Hentzel

[57] ABSTRACT

A closure device clamps over the plug to an appliance for securing the appliance from unauthorized use. The closure device has a base and an opposed hinged cover which closes over the base to enclosed the plug. Twin posts extend upward from the base for engaging twin apertures in the cover when the device is closed. Caps on the posts lock the device closed, and must be severed to remove the posts from the apertures.

28 Claims, 5 Drawing Sheets

SECURITY DEVICE FOR ELECTRIC APPLIANCES

TECHNICAL FIELD

This invention relates to electrical appliance security devices, and more particularly to such devices which secure the appliance by capturing the plug.

BACKGROUND

Heretofore unauthorized use of expensive, delicate or dangerous electrical equipment and machinery has been prevented by traditional lock-and-key devices such as taught in United States Letter Patents:

U.S. Pat. No. 2,654,037 issued Sept. 29, 1953 to Katz,

U.S. Pat. No. 4,488,764 issued Dec. 18, 1984 to Pfenning,

U.S. Pat. No. 4,592,607 issued June 3, 1986 to Pejovie, and

U.S. Pat. No. 4,648,667 issued Mar. 10, 1987 to Baumgart.

The plug on the cord to the electrical equipment was placed in a strong, tamper proof container which was then closed and secured shut by a lock.

The key was available to authorized personnel only. Unauthorized personnel were unable to open the container, and were prevented from using the secured device unless they had possession of the key. Mere verbal permission from the authorized personnel was insufficient. The key had to be located and brought to the equipment location. Without keys, unauthorized personnel were unable to exercise discretion in emergencies or other unforeseeable situations.

A second disadvantage of these lock-and-key devices concerned the long lifetime of the lock mechanism. Over the years many extra keys were made, and unauthorized personnel eventually possessed unauthorized keys. The security of the lock-and-key devices became diluted.

U.S. Pat. No. 4,219,693 issued Aug. 26, 1980 to French teaches a security technique which discourages unauthorized use of electronic equipment; but does not physically prevent unauthorized use. The input cable to the electronic device was secured within a brittle plastic shell. The shell was formed by opposed halves which snap together around the cable to prevent use. The shell had to be broken and removed in order to install the cable and use the equipment. A missing shell, or pieces of a broken shell, indicated unauthorized use. The fear of post use detection discouraged tampering by unauthorized individuals.

SUMMARY

It is therefore an object of this invention to provide an improved appliance security device for discouraging unauthorized use of secured appliances.

It is another object of this invention to provide such an appliance security device which may be easily installed over the appliance plug by hand without the use of tools.

It is further object of this invention to provide such an appliance security device which is difficult to remove from the appliance plug without a suitable cutting tool.

It is further object of this invention to provide such an appliance security device which is inexpensive.

It is further object of this invention to provide such an appliance security device which reveals unauthorized use of the appliance.

It is further object of this invention to provide such an appliance security device which prevents young children from accessing the secured electrical appliance.

It is further object of this invention to provide such an appliance security device which supports use discretion by an unauthorized user.

Briefly, these and other objects of the present invention are accomplished by providing an electrical appliance security device having an open condition and a closed condition for retaining the plug of an electrical cord. The device has a base for receiving the plug when the security device is in the open condition, and an opposed cover which cooperates with the base to form a plug retaining chamber when the security device is in the closed condition. A port permits the electrical cord to extend out of the chamber. A post and cap latch secures the base and cover together when the security device is in the closed condition. The post must be severed to permit the security device to open and release the cord.

BRIEF DESCRIPTION OF THE DRAWING

Further objects and advantages of the appliance security device and the post use detection feature will become apparent from the following detailed description and drawing in which.

Figure 1:
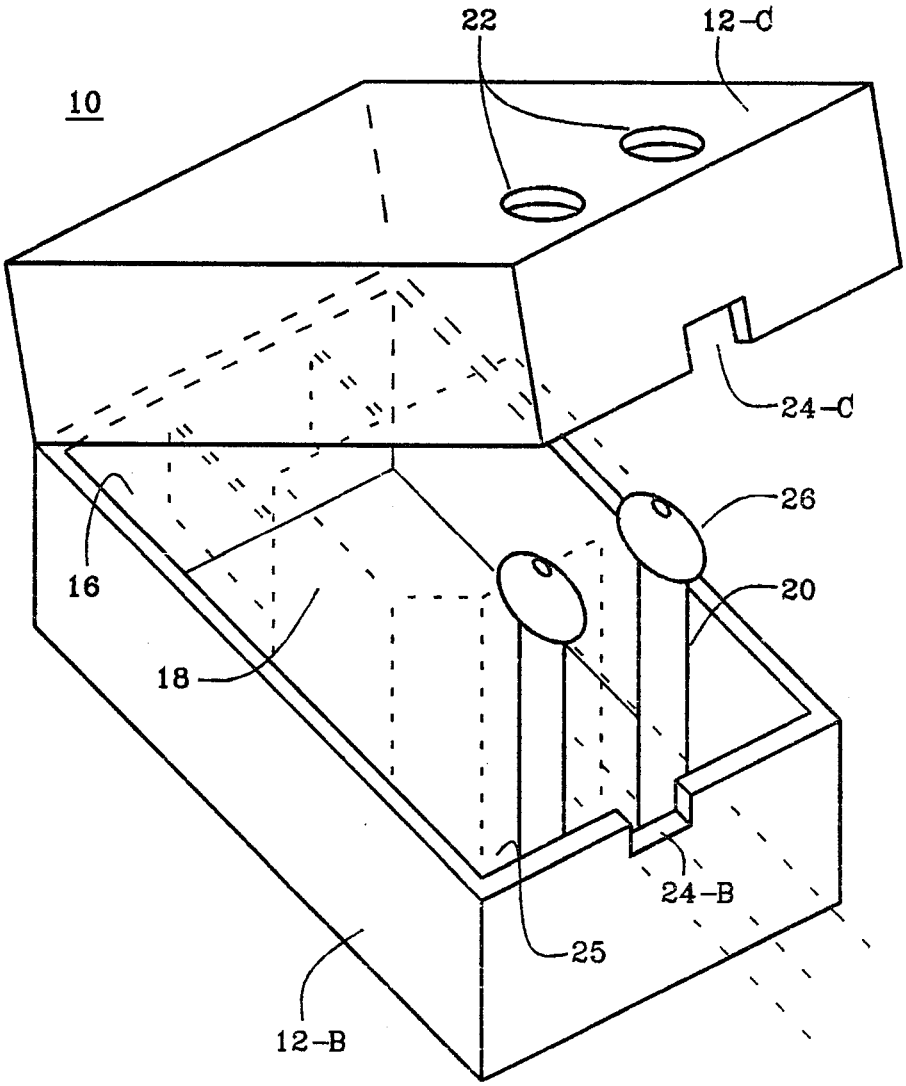
FIG. 1 is a perspective view of a general embodiment of an appliance security device shown in the open condition for receiving the appliance plug.
Figure 2:
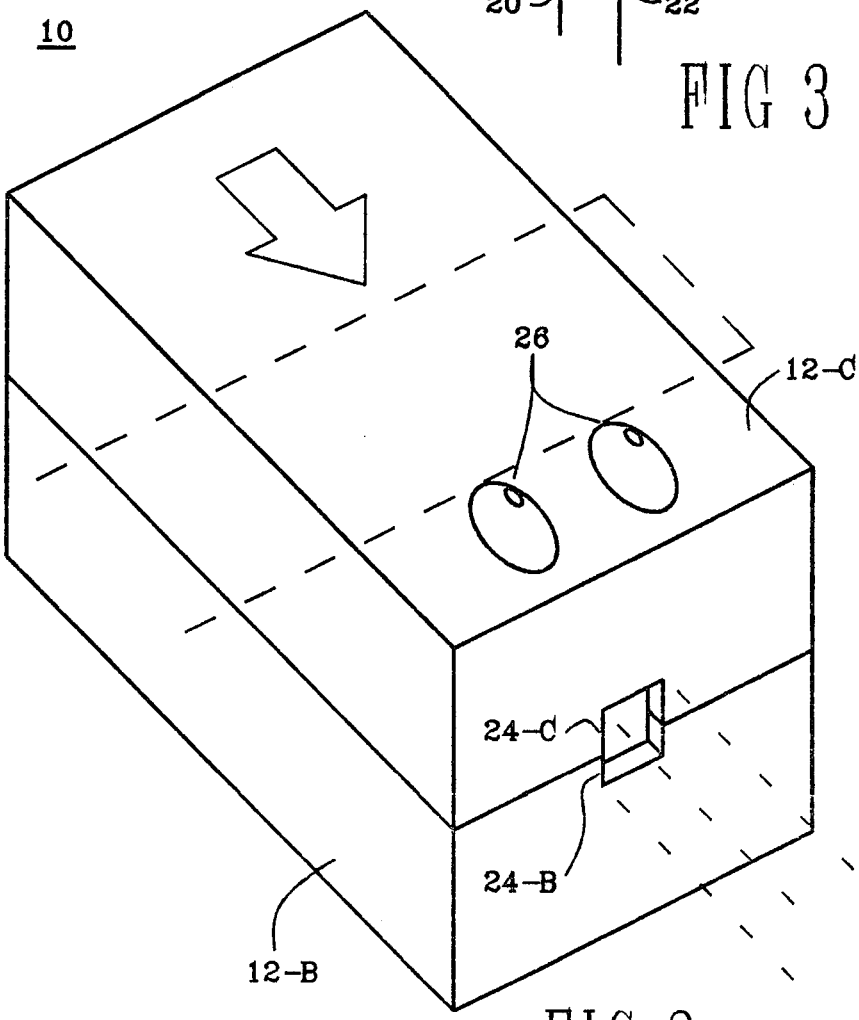
FIG. 2 is a perspective view of the appliance security device of FIG. 1 shown in the closed condition for securing the appliance plug.

GENERAL EMBODIMENT (FIGS. 1 and 2)

Security device 10 has a lower or base closure member 12-B and an opposed upper or cover closure member 12-C hinged thereto at one end. Device 10 forms a closable "clam" like chamber 16 for receiving plug 18 (shown in dashed lines) of an electrical appliance to be secured. The plug is mounted within chamber 16 when security device 10 is in the open condition as shown in FIG. 1. Latching means such as twin locking posts 20 extend upward from base 12-B and engage twin locking apertures 22 in cover member 12C for holding the closure members together. The plug is secured within the chamber when the device is in the closed condition as shown in FIG. 2. Cord port means such as opposed notches 24-B and 24-C along the edge of the closure members 12-B and 12-C permit the cord of the appliance to extend out of the chamber. The notches are preferably located in the end of the security device opposite to the hinge.

The plug to be secured is placed in the chamber area of base 12-B with the cord resting in cord channel 25 between locking posts 20 and lower notch 24-B. Cover 12-C is pressed downward against base 12-B causing posts 20 to pass through locking holes 22. The posts have conical caps 26 slightly larger than locking holes 22, which self center into the holes. The resulting snap-lock of the peripheral portion of the caps past the edge of the holes prevents separation of the closure members. The closure is secured in the closed condition and plug 18 is unaccessible. Locking posts 20 are spaced to guide the cord toward lower notch 24-B, and position the plug properly within the chamber prior to closure.

In order to access the plug, the cone caps are sheared off using a suitable cutting edge (shown in dashed lines in FIG. 2) such as a blade, scissors or clippers. The locking posts are freed from the locking apertures, permitting the closure members to open releasing the plug from the chamber. The cutting instrument is guided by the top surface of the cover member, and does not penetrate the shell or enter the chamber. Damage to the insulation of the plug and cord is avoided.

Figure 3:
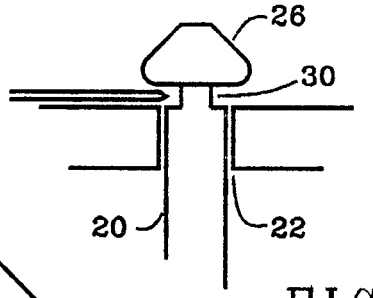
FIG. 3 is a fragmentary view in section showing a locking post with a cutting groove defining the location of the sever between the post and the cap.

In order to facilitate shearing the caps, the locking post may be provided with a cutting groove 30 immediately beneath the cap as shown in FIG. 3. The cutting groove defines the location of the cut and minimizing the effort required to execute the cut. The cutting edge slips into the crevice between the overhanging periphery of the cap and the surface of the top cover, and is directed into the cutting groove. The loss of material in the post due to the cutting groove does not affect the closing of the chamber which presents only a compressive load on the post.

Security device 10 does not physically prevent access to the plug, but severely discourages access due to the shame-guilt reaction of the tamperer who knows his access will be discovered. The missing caps are concrete evidence of unauthorized access. In unusual situations, unauthorized users may exercise user discretion, and open the chamber, access the plug and use the secured appliance. The security device is designed to prevent access to personal appliances such as TVs and PCs in noncritical situations. For dangerous electrical equipment such as power tools, conventional lock-and-key devices should be employed.

The security device may be color coded (and/or symbol coded) to prevent installation of an identical replacement device after unauthorized access. The remainder of the surface area on either shell is available for warnings and instructions. Authorized access to the secured appliance requires only verbal permission such as over a telephone, and a cutting instrument. Transfer of a key is not necessary.

REMOVABLE COVER EMBODIMENT (FIG. 4)

Figure 4:
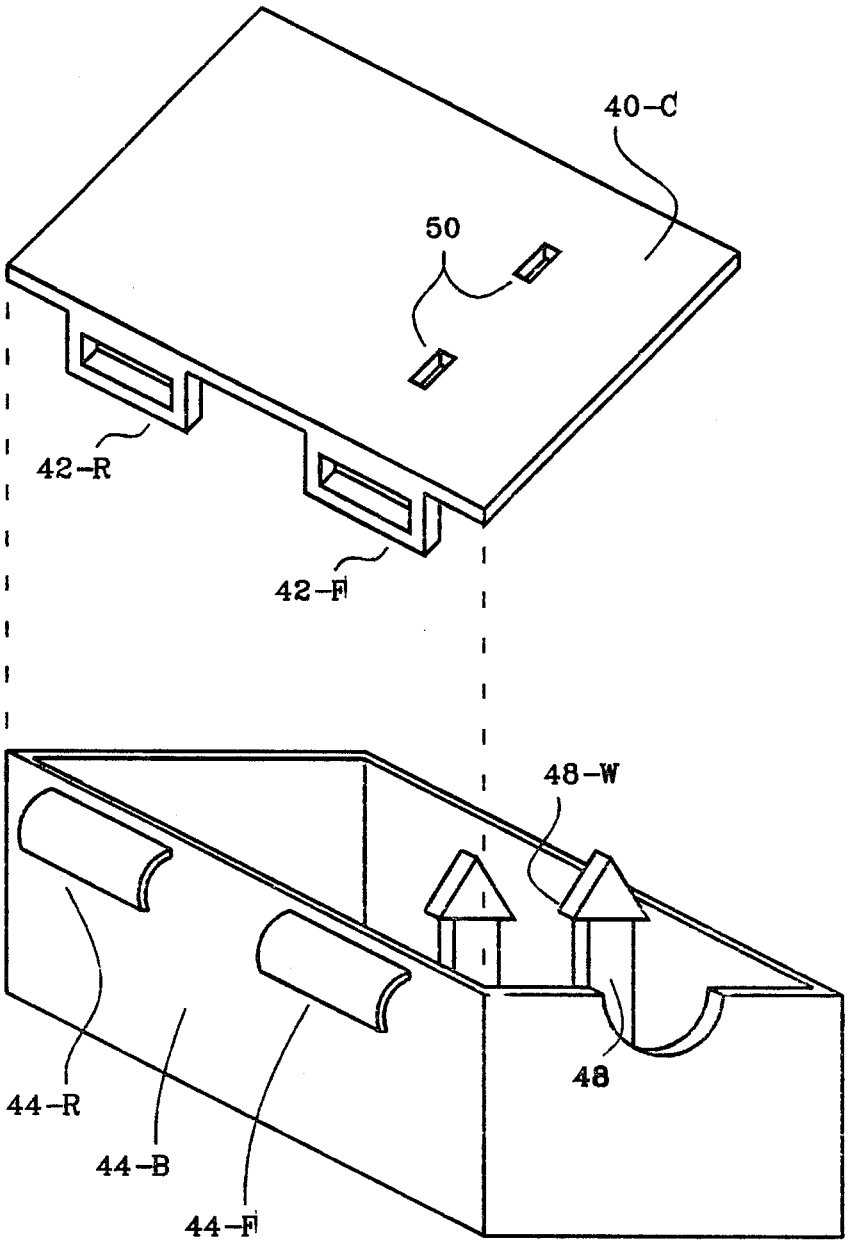
FIG. 4 is a perspective view of a releasably hinged embodiment of the appliance security device in which the cover member is removably hinged to the base member
Figure 5:
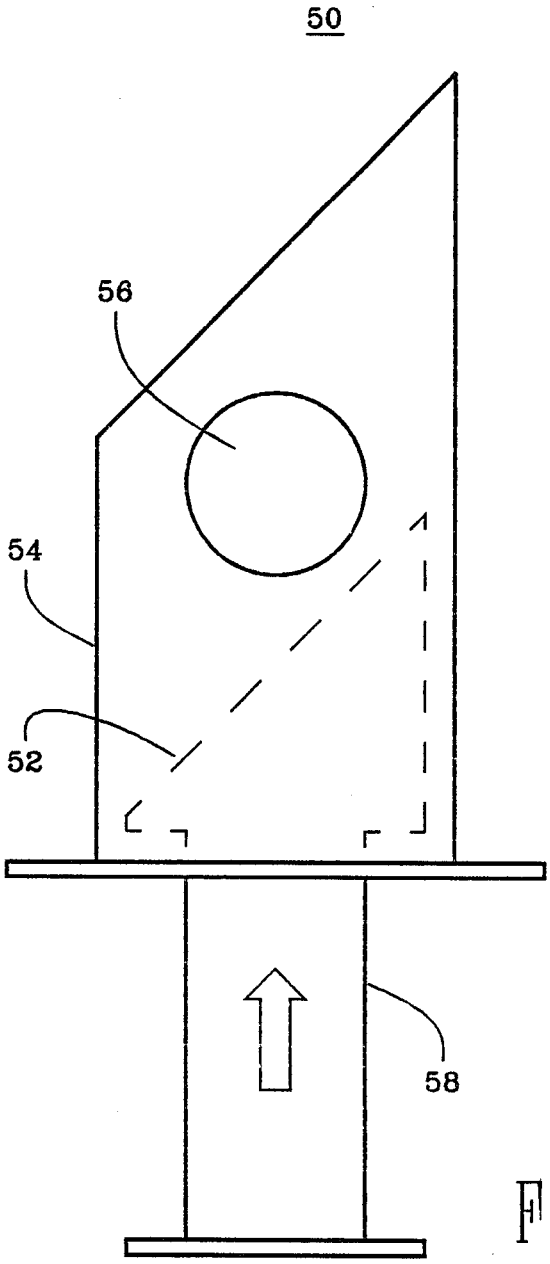
FIG. 5 is a broken away view of a cutter for removing the post cap to release the appliance plug.
Figure 6:
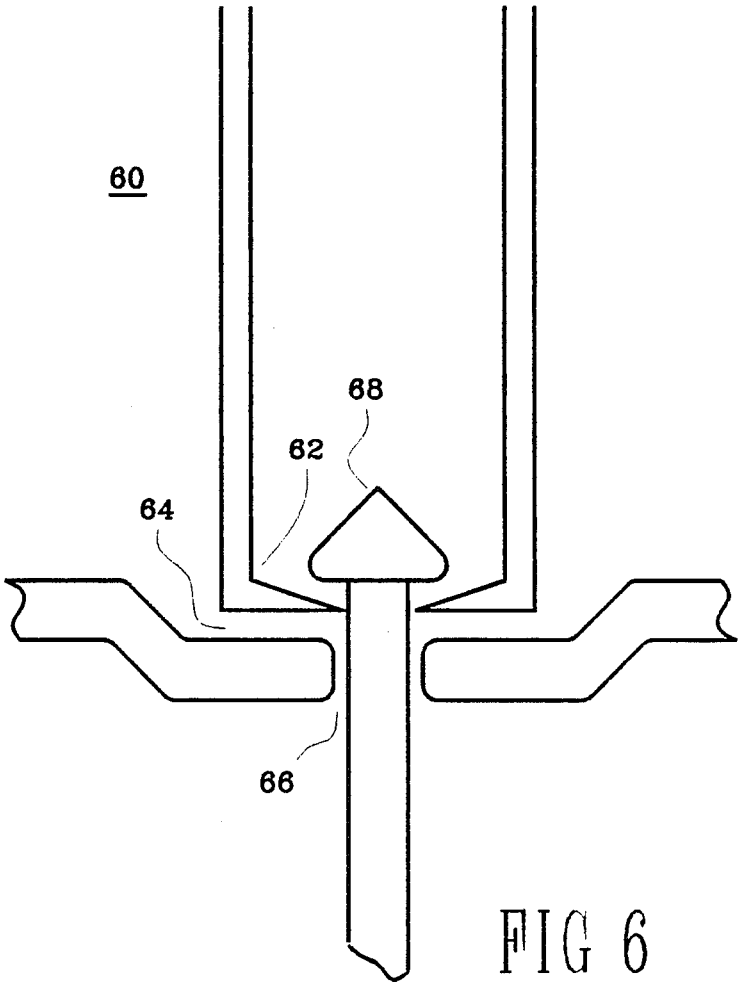
FIG. 6 is a fractional view in section showing a locking aperture having a submerged perimeter.

A removable cover embodiment in which the cover closure member is removably hinged to the side of the base closure member is shown in FIG. 4. Cover 40-C has downward extending forward and rear edge flanges 42-F and 42-R extending along a side of major dimension. The flanges have hinge slots therein for engaging forward and rear curved hinge tabs 44-F and 44-R on base 40-B. In the open condition shown in FIG. 4, the cover is completely removed from the base permitting ready access to the plug chamber. To close the device, the hinge slots are engaged over tabs 44, and the cover is pivoted to close over the base.

Twin arrow posts 48 extending upwards from base 40-B engage twin locking slots 50 in cover 40-C for locking the cover in the closed position. The points of the arrows slip into the locking slots and snap-lock as the wider wing portion 48-W of the arrows pass through the slots.

The arrows also assist in retaining the cord in the cord channel between the securing posts during mounting of the plug. The cord is guided by the arrow heads and easily slips into the channel. The inside wings of the arrows trap the cord within the channel until the cover is closed thereover.

HOUSED CUTTING BLADE (FIG. 5)

Cutting device 50 has a cutting blade 52 slideably mounted within a flat housing 54 for severing the caps from the locking posts. The cap to be severed is retained within cutting aperture 56, and blade plunger 58 is pushed forward into housing 54. Cutting blade 52 is connected to the plunger, and is displaced past the cutting aperture to sever the post cap. The cutting blade in cutter 50 is never exposed to the user during normal use.

SUBMERGED APERTURE EMBODIMENT (FIG. 6)

Cutting device 60 has nosed shaped snipping blades 62 for entering a submerged perimeter region 64 around aperture 66 to snip off cap 68. Ordinary cutting blades cannot enter submerged perimeter region 64. This recessed cap embodiment is particularly difficult for children to open.

SPECIFIC EMBODIMENT

The follow particulars of the security device are given only as an illustrative example.

Overall dimensions of the security device
- height $1\frac{1}{4}$ inches (3 cm)
- width $1\frac{1}{2}$ inches (3.8 cm)
- length 3 inches (7.6 cm).

Dimensions of the post, cap and aperture
- post height with cap $1\frac{1}{2}$ (3.8 cm)
- post diameter $\frac{1}{8}$ inches (0.32 cm)
- cap diameter $\frac{1}{4}$ inches (0.64 cm)
- aperture diameter 3/16 inches (0.48 cm).

The dimensions and material give above are not intended as defining the limitations of the invention. Numerous other applications and configurations are possible.

INDUSTRIAL APPLICABILITY

It will be apparent to those skilled in the art that the objects of this invention have been achieved by providing an improved appliance security device for discouraging unauthorized use of secured appliances as described hereinbefore. The security device which may be easily installed over the appliance plug by hand without the use of tools merely by placing the cord into the device and snapping the device shut. The device locks in the closed condition making it difficult to remove from the appliance plug without a suitable cutting tool. The missing caps reveals unauthorized use of the appliance. In addition young children are prevented from accessing the secured electrical appliance because they cannot sever the caps. Unauthorized discretion is possible because a key is not required.

CONCLUSION

Clearly various changes may be made in the structure and embodiments shown herein without departing from the concept of the invention. Further, features of the embodiments shown in the various Figures may be employed with the embodiments of the other Figures. Therefore, the scope of the invention is to be determined by the terminology of the following claims and the legal equivalents thereof.

(1) Security Device
Base
Cover
Chamber
Port
Latch
(2) Latch Mns
Post Mns
Aperture Mns
(3) Cap Mns on Post
(4) Larger Than Aperture
(5) Cone Cap
(6) Arrow Cap
(7) Guide for Cutting
(8) Cutting Groove
(9) Aperture Pit
(10) Severing Means
(11) Shaped
(12) Snipper
(13) Nose
(14) Post on Base
Aperture on Cover
(15) Pair of Posts and Apertures
(16) Guide Channel
(17) Port in Cover only
(18) Port in Base only
(19) Base major Closure Member
(20) Port retains Cord during installation
(21) Port in Both Base and Cover
(22) Base same size as Cover
(23) Closure Members separate when open
(24) Closure Members hinged
(25) removeably hinged
(26) along major side
(27) along minor side
(28) opposite Port

I claim as my invention:

1. An electrical appliance security device having an open condition and a closed condition for retaining a plug to an electrical cord, comprising:

a base closure member for receiving the plug when the security device is in the open condition;

an opposed cover closure member which interfaces with the base closure member to form a plug retaining chamber when the security device is in the closed condition;

port means for permitting the electrical cord to extend out of the plug retaining chamber; and severable latch means for securing the closure members together when the security device is in the closed condition, which must be severed to permit the closure members to open and release the cord.

2. The security device of claim 1, wherein the severable latch means further comprises:

post means extending from one of the closure members toward the other cover closure member; and aperture means in the other closure member for receiving the post means when the security device in in the closed condition.

3. The security device of claim 2, wherein the post means further comprises a cap means on the end thereof having an overhanging peripheral portion extending therefrom for engaging the aperture means and holding the closure members together when the security device is in the closed condition, which when severed from the post means permits the closure members to open into the open condition.

4. The security device of claim 3, wherein the cap means is larger than the aperture means.

5. The security device of claim 4, wherein the cap means is cone shaped to facilitate passing through the aperture means.

6. The security device of claim 4, wherein the cap means is arrows shaped to facilitate passing through the aperture means.

7. The security device of claim 3, wherein the overhanging peripheral portion of the cap means guides the severing when the cap means are severed.

8. The security device of claim 7, wherein the post means has a groove proximate the cap means for defining where the cap means is severed from the post means.

9. The security device of claim 3, wherein the perimeter region adjacent to the aperture means is submerged.

10. The security device of claim 9, wherein the security device further comprises a severing means for severing the cap means from the post means to permit the closure members to open into the open condition.

11. The security device of claim 10, wherein the severing means is shaped to enter the submerged perimeter region and sever the cap means.

12. The security device of claim 11, wherein the severing means is a snipper means having a pair of opposed severing edges for severing the cap means from the post means.

13. The security device of claim 12, wherein the snipping means is nose shaped to enter the submerged perimeter region and sever the cap means.

14. The security device of claim 3, wherein the post means is on the base closure member and the aperture means is on the cover closure member.

15. The security device of claim 14, wherein the post means comprises a pair of posts and the aperture means comprises a pair of apertures.

16. The security device of claim 15, wherein the pair of posts are spaced to define a guide channel for retaining the appliance cord.

17. The security device of claim 1, wherein the port means is a notch in the cover closure member along the interface with the base closure member.

18. The security device of claim 1, wherein the port means is a notch in the base closure member along the interface with the base closure member.

19. The security device of claim 18, wherein the base closure member is the major closure member and retains the plug while the cover closure member is closed thereover.

20. The security device of claim 19, wherein the port notch in the base closure member retains the cord proximate the plug while the plug is retained in the closure means.

21. The security device of claim 1, wherein the port means is formed by a closure notch in the cover closure member and a base notch in the base closure member along the interface between the cover closure member and the base closure member.

22. The security device of claim 21, wherein the upper notch is the same size as the lower.

23. The security device of claim 1, wherein the closure members separate when the security device is opened to the open condition.

24. The security device of claim 1 wherein the closure members are hinged together to effect the open condition and the closed condition.

25. The security device of claim 24 wherein the closure members are removably hinged together and separate when the closure is opened.

26. The security device of claim 24, wherein the closure members are hinged along a major side.

27. The security device of claim 24, wherein the closure members are hinged along a minor side.

28. The security device of claim 27, wherein the closure members are hinged along the side opposite to the port means.

* * * * *